United States Patent [19]

Schultz

[11] 3,940,576

[45] Feb. 24, 1976

[54] LOUDSPEAKER HAVING SOUND FUNNELLING ELEMENT

[76] Inventor: Herbert J. Schultz, 2627 Bourbon St., No. 3D, Orange, Calif. 92665

[22] Filed: Mar. 19, 1974

[21] Appl. No.: 452,614

[52] U.S. Cl. ..... 179/181 R; 179/116; 181/163; 181/173

[51] Int. Cl.[2] ..... H04R 7/12

[58] Field of Search ..... 179/181 R, 116, 115 R; 181/160, 173, 164, 165, 157 R, 159, 163

[56] References Cited

UNITED STATES PATENTS

| | | | |
|---|---|---|---|
| 1,673,939 | 6/1928 | Farrand | 179/181 R X |
| 2,034,882 | 3/1936 | Scribner | 181/165 |
| 2,852,089 | 9/1958 | Cohen et al. | 181/159 |
| 3,310,131 | 3/1967 | Ward | 179/181 R |

*Primary Examiner*—Thomas W. Brown
*Attorney, Agent, or Firm*—Grover A. Frater

[57] ABSTRACT

An elliptically tapered tube or funnel shaped element is fixed to a loudspeaker so that its large diameter end overlies a central region of the loudspeaker diaphragm and such that its small diameter end extends away from the diaphragm. The loudspeaker diaphragm need not extend beyond the line on which it is connected to the funnel element, but does in the preferred embodiment. The funnel element has a cross-sectional shape that differs on planes parallel to the plane of the base which lie at different distances from the base. A funnel that is circular in cross-section at all of those parallel planes does not exhibit high fidelity response with the brilliance and clarity that distinguishes speakers having the non-uniform cross-sectional shape.

8 Claims, 7 Drawing Figures

LOUDSPEAKER HAVING SOUND FUNNELLING ELEMENT

This invention relates to improvements in loudspeakers of the kind that convert the electrical output of radio and television receivers and sound systems and other apparatus in which output signals are to be broadcast as sound.

An object of the invention is to produce a speaker having substantially greater fidelity than has heretofore been provided by speakers of comparable cost. Most loudspeakers include a paper diaphragm of circular or elliptical shape. The outer margin of the diaphragm is held in a frame and its center is fixed to an electromagnetic actuator. The electro-magnetic actuator comprises two parts, one of which is fixed to the diaphragm frame and the other one of which is attached to the central region of the diaphragm.

In an ideal speaker, the diaphragm vibrates in a way which would result in the development and radiation of acoustic compressions and rarefactions corresponding exactly to the variations of the electrical signal applied to the speaker. Ideal operation, however, is not reached in practice because the physical elements comprising the speaker have mass which moves in varying degrees in response to a given level of power input and different frequencies.

The frequency response characteristic of an actual speaker depends upon its physical dimensions, the velocity of wave propogation through the materials of its elements, and a number of other factors. In all but a few cases the complexity of the problem precludes rigorous pre-calculation of the frequency response characteristic of a given speaker. That means that synthesis of a speaker design to produce a speaker with uniform frequency response is simply not possible. Speaker designs evolve primarily on the basis of emperical relationships.

Notwithstanding the difficulty in evolving a design, it is possible by observing speakers with different frequency response characteristics to determine what happens in a speaker when its response to an input signal is good.

It can be demonstrated that the different parts of a speaker, and in particular the regions that encircle the central part of the diaphragm at different distances from the center, exhibit different natural frequencies of resonance. This means, instead of a single resonant frequency which is applicable to the whole of a speaker element, there appear to be natural resonant frequencies that are identified with different sections of the structure. When the natural resonant frequency of a particular section of a speaker element corresponds closely to the input vibration frequency that will make that section vibrate, then the amplitude of vibration will be enhanced. The result of this phenomenon is that a speaker will reproduce signals of one or more frequencies with greater amplitude, for a given input power, than it will reproduce signals at other input frequencies. That disparity in sound output levels for a given input level and frequency may be referred to as a non-uniformity of response. By definition, that is less than perfect fidelity.

Speaker manufacturers have devised a number of expedients with which to minimize this frequency selective effect. In general, such expedients result in increased speaker manufacturing costs whereby the terms "inexpensive speaker" and "poor fidelity" have become synonymous. Similarily, the terms "expensive speaker" and "high fidelity" have become closely associated. Speakers of small size are generally expected to have, and usually do have, relatively poor frequency response characteristics. It is an object of this invention to provide a speaker which adds little cost to the conventional speaker while greatly adding to its fidelity. Another object is to make possible a given fidelity level in smaller size speakers than has heretofor been possible.

Most loudspeakers use a cone shaped diaphragm. The cone is relatively shallow in that the height of the cone is a small fraction of the diameter of the cone at its base. When a speaker has such a circular diaphragm, sound emanates from a circular area around the central axis of the diaphragm. The vibrations at individual points in that circular area tend to cancel one another in certain directions and to reinforce one another in other directions. The result is that such speakers are substantially omnidirectional in their operation, which is generally true for all frequencies. Speakers tend to become unidirectional when the speaker cone is tapered in greater degree such that the height-to-base ratio is increased.

Not all speaker diaphragms are circular. It has become common to manufacture speakers in which the margins form an ellipse and are mounted in an elliptical frame. While there are claims that specific speakers of one form or another provide better fidelity, there appears to be no evidence that one form is generally better than the other for high fidelity sound production. The comparison between the fidelity of circular and elliptically shaped speakers is made because this invention, with an elliptical shape, provides a higher fidelity than it does with a circular shape. In the invention, a conventional speaker diaphragm, or speaker cone, is supplemented with a "funnelling" element which is fixed to the forward side of the diaphragm. The term "funnelling" is used to denote a tubular member which is tapered along its length from a large opening at one end to a smaller opening at the other. In the preferred form of the invention, the margin at the large opening is elliptical. The cross-sectional configuration becomes less elliptical on successive transverse planes. That is, the member becomes more circular toward the smaller opening and has a substantially circular cross-section at the smaller opening.

The margin of the larger opening is called the base. The base is fixed to the diaphragm of the speaker. That diaphragm may be either elliptical or circular. In the preferred embodiment it is elliptical, and is larger in area than the area of the funnel base by approximately two times. One function of the funnel is to direct sound waves from the diaphragm to a region outside of the funnel opening. The sound waves proceed from that region as from a point source. There is somewhat greater sound transmission in the direction of the axis, the center line, of the funnel. However, that effect is minimal and speakers made according to the invention are essentially omnidirectional.

The surface of the funnel vibrates greatly as the speaker is excited. When excited by a sinusoidal wave, a single frequency, surface vibrations occur in maximum degree in a band around the circumference of the funnel at that distance. The distance from the base to that band increases with frequency. Shortening the funnel and making its slant angle more acute would extend high frequency response. Making the base wider and adding to the area of the speaker diaphragm would extend low frequency response.

The effect is to greatly increase the area that can vibrate in response to electrical stimulation. Thus, each area vibrates in response to excitation by a smaller range of frequencies. The result is faithful reproduction of complex signals with increased brilliance and clarity then exhibited in smaller speakers heretofore.

This advantage is not fully achieved if the funnel is a regular cone. It appears that the attempt to make a conical funnel vibrate in a circular area results in greatly diminished selectivity of area of vibration. Such a unit vibrates in a mode which is not as frequency selective. However, if the funnel is not symmetrical about the center line of the speaker, the wide band response characteristic is exhibited. That appears to be the criteria. When it is desired to practice the invention at lowest cost, it is advantageous to add the funnel structure to conventional circular or elliptical speaker with its center line substantially coincident with the speaker axis. That arrangement will provide the improved result with a minimum cost funnel, and without need for basic redesign of existing speakers. It is the currently preferred arrangement or mode of practicing the invention. A conical funnel or right circular cone is avoided by making the funnel elliptical in cross-section at its base and less elliptical at successively greater distances from the funnel base. The limit of that change in cross-sectional shape is a circle. The funnel terminates in a circular opening in the preferred embodiment because that provides the strongest construction.

The funnel should have physical characteristics like those of the diaphragm, if possible. Its outer end is unsupported and may be subject to damage. To add strength, a thin coating of rubber and a metal reinforcing ring may be added to the funnel. The expedient is also useful in strengthening the conventional speaker diaphragm, and, if that is done, the elastomeric covering of one is bonded to the covering of the other to aid in continuity between the funnel element and the diaphragm.

The connection between funnel and diaphragm should be continuous around the base of the funnel, and may be made using any effective adhesive material. "White glue" was used as the bonding agent on the proto-types.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which: In the drawings:

Figure 1:
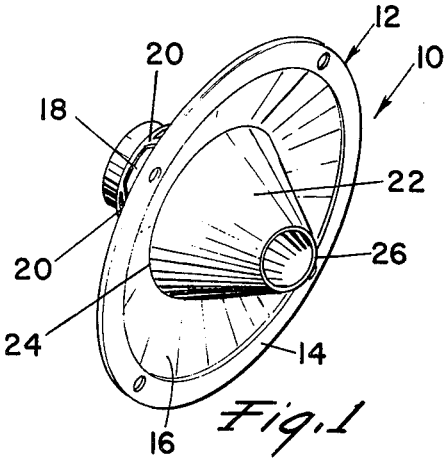
FIG. 1 is a pictorial view of a speaker that embodies the invention.

To facilitate understanding of the invention, and to enable a comparison of a speaker made according to the invention with a prior art speaker, as well as to describe what is now considered to be the best mode of practicing the invention, the unit of FIG. 1, 2, 3 and 4 was constructed by adding a funnel element to an elliptical speaker. The latter is representative of many of the smaller, less expensive speakers that are widely used in electronic apparatus made for the consumer market. In this case, the speaker measures nine inches across its widest dimension and six inches across its narrow dimension. The center of the diaphragm, or cone, is displaced from the plane of its outer margins by about one inch. The central region of the diaphragm is fixed to a voice coil that cooperates with a permanent magnet carried by the frame. The diaphragm is made of common felt paper.

The funnel element is approximately four and five-eighths inches high. The small end is circular and its opening is approximately one and one-half inches in diameter. The base of the funnel is about five inches wide across its widest side and approximately three and one-third inches wide across its narrow dimension. The margin of the larger opening, the base, lies on a plane and is secured by an adhesive, such as white glue, to the diaphragm of the speaker so that the center line of the funnel element, "the axis of the circular end," is coincident with the axis of the speaker diaphragm.

In this embodiment, the margins of the smaller opening lie on a plane that is parallel to the plane of the base. The funnel element was formed by bending a piece of calendered paper into conical shape and by gluing together overlapping portions of the board to form a truncated cone. The board was trimmed to form the margins of the larger end along a line such that that margin would lie on a plane when the opposite sides of the cone were compressed toward one another, such that the large end of the funnel assumed an elliptical shape. The funnel element, thus formed and compressed, was glued to the cone. It was coated with a thin layer of a polymer that hardened to a synthetic rubber surface. The result being a strong funnel of which the surface is capable of vibrating.

The speaker, thus constructed, exhibited the ability to produce sound in a frequency range of approximately 27 Hz to 18.5 kHz. The free air resonant frequency of the speaker before addition of the funnel shaped element was measured to be approximately 137 Hz. After addition of the funnel element, the free air resonant frequency decreased in measurement to approximately 68 Hz. Some variation in measurements existed in the second speaker constructed. Its before and after measurements were 130 Hz to 71 Hz. In the completed unit, the radius, $R_1$, of the small end of the funnel was 0.812 inches. The average dimension of $R_2$, from the center line of the cone to the margin at the base was 2.03 inches and the height, $h$, from the plane of the base to the plane of the small end of the funnel was 4.625 inches.

Applying the formula:

Volume $=\therefore \pi h\ (R_1^2+R_2^2+R_1R^2)$, the volume of the "elliptical cone" or the funnel element is approximately 29.76 cubic inches. The average wave length over the range from 68 Hz to 20 kHz can be found by integration to be 386 Hz. The formula for that calculation is given as follows:

$$V = f\lambda;\ f = v/\lambda;\ f_{average} = V \int_a^b \frac{1}{\lambda} \times \frac{1}{(b-a)}$$

$V = 1.12 \times 10^3$ feet/sec = velocity of sound in air
$b = 0.05$ feet = wavelength of 20 kHz
$a = 16.5$ feet = wavelength of 68 Hz Helmholtz has developed a formula well known in acoustical engineering for finding the frequency of natural resonance in ported containers, which would include those shaped like a funnel, on the basis of its volume and port area. That formula is written:

$$F_r = 2070\ (A/V^2)^{1/4}$$

The conversion efficiency of the speaker appears not to be altered substantially by addition of the funnel element. That is, the speaker produced about as much sound energy in response to a given exciting signal with the funnel in place as it did without the funnel. That result was unexpected. The mechanical impedance of a speaker exceeds air impedance. For that reason, coupling elements intended for matching a speaker source to the air to insure maximum energy transfer have their small diameter end at the speaker source and their larger diameter end coupled to the air. Those matching devices would be conically shaped. In this invention, the acoustic transformer, here called the funnel, is turned around so that the large diameter end is coupled to the speaker and the small end is coupled to the air. What is unexpected is that coupling efficiency appears not to have been lost and broad band response is gained.

In FIG. 1, the speaker, which is generally designated 10, comprises a conventional elliptical speaker 12, having an outer frame 14, to which the margins of a diaphragm 16, are fixed. Extensions 20, of the frame 12, extend rearwardly toward the central axis of the speaker and they are fixed to a magnet 18. As previously indicated, the speaker thus far described is old and it is substantially like many currently used permanent magnet speakers.

Figure 2:
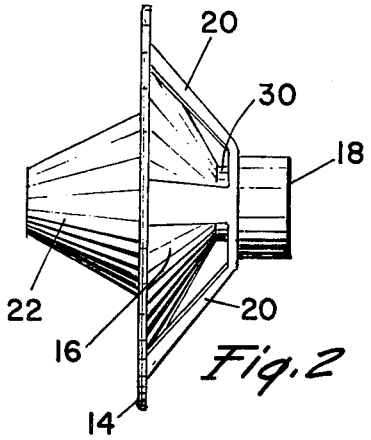
FIG. 2 is a view in side elevation of the speaker of FIG. 1.
Figure 4:
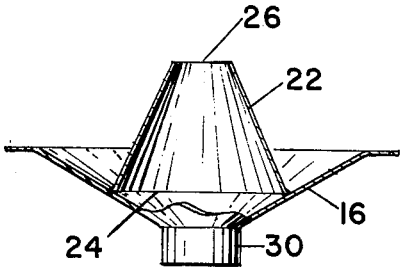
FIG. 4 is a cross-sectional view taken on line 4—4 of FIG. 3 showing the speaker diaphragm, the voice coil and the sound funnel.
Figure 3:
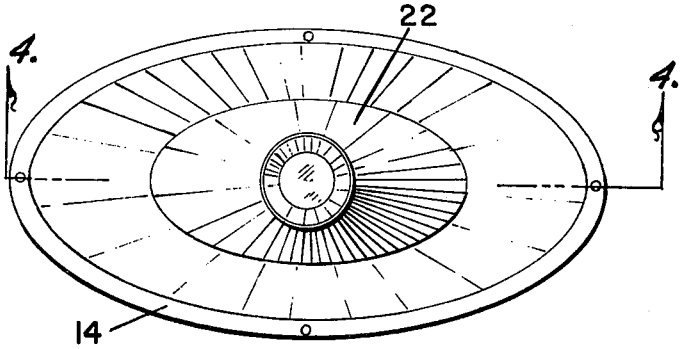
FIG. 3 is a view in front elevation of the speaker of FIG. 1.

The frustrated elliptical cone, or funnel element 22, has the dimensions previously described, as best shown in FIGS. 2, 3 and 4. The funnel element is centered over the central region of the diaphragm 16, and its voice coil 30. The fact that the funnel is elliptical at its base and round at its outer end is best shown in FIG. 3.

It appears that an important factor in successful operation of the invention is the fact that the funnel element is not circular in cross-section on planes parallel to the plane of the margins of the diaphragm, or to the average plane of the base of the funnel. It may be circular at one plane without loss of the advantages of the invention. Thus, the speaker of FIGS. 1 through 4 is not rendered inoperative and its function is not degraded by the fact that the funnel ends at its outer end in a circular shape.

It is necessary in the invention that the funnel be tapered from its base opening to a smaller opening at the outer end. The degree of that taper does not appear to be especially critical as long as volume and port size are maintained. The proportions given in the example have exhibited good performance. It is considered that the funnel should be at least half as long as the base at its greatest width and the opening, or port, at the end of the funnel element is best made with a diameter that is between one-half and one-fourth of the funnel length.

The mathematical expressions given previously may be employed to discover appropriate dimensions for a funnel to be used with a given speaker and desired range of response.

Figure 5:
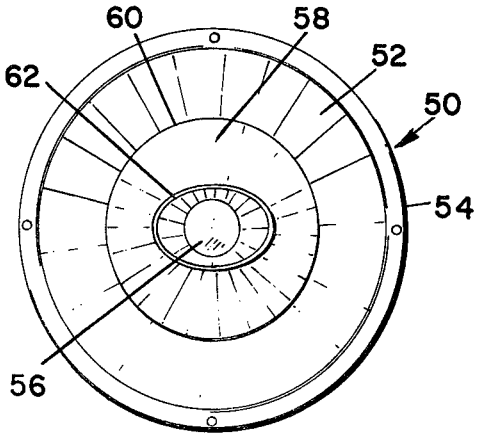
FIG. 5 is a view in front elevation of another embodiment of the invention.

The embodiment of FIG. 5 employs a round speaker 50, in which a circular diaphragm 52, is fixed at its margins to a circular frame in 54. The diaphragm 52 describes a shallow cone and extends rearwardly into the frame, to a central region 56, at which point the voice coil is attached to the rear of the speaker. A funnel element 58, is centered on the diaphragm 54. The margin of the cone that defines its base is designated 60, and it is circular. The funnel element extends upwardly in FIG. 5, toward the viewer, from a fixed connection to the diaphragm 52, at the base and terminates in an elliptical opening 62. Except at the base, the cross-section of the funnel taken on a plane parallel to the plane of its base is not circular at any point other than at the base, and the degree of circularity at one plane is different from the degree of circularity and the degree of ellipticity at any other parallel plane. That construction falls within the invention. It will produce a broad band, high fidelity response, and is one of the preferred embodiments.

Figure 7:
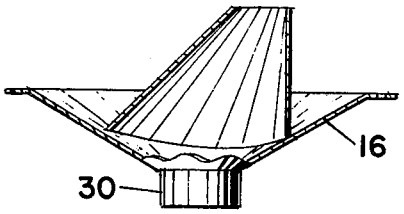
FIG. 7 is a cross-sectional view taken on line 7—7 of FIG. 6 showing parts of the third embodiment.
Figure 6:
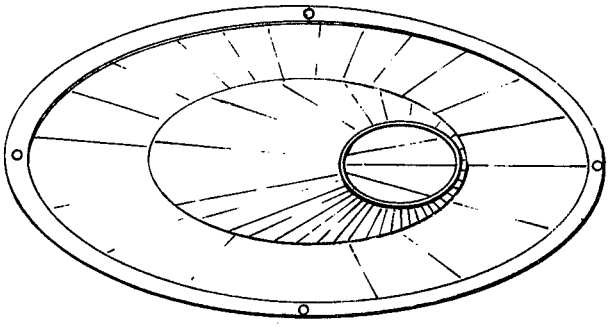
FIG. 6 is a view in front elevation of a third embodiment.

Another embodiment is shown in FIGS. 6 and 7. This embodiment is more costly and is now considered to be less desirable than the others, but it illustrates that the invention is applicable to other shapes. In this case, the funnel is conical, but its upper and lower margins are cut on a bias so that both the upper and lower openings describe an ellipse. However, the degree in which the funnel is elliptical differs at each different distance from the base. As best shown in FIG. 7, the funnel element is mounted with its base lying on a plane that is parallel to the plane of the margins of the diaphragm and that means that it lies on a plane that is substantially perpendicular to the axis of the speaker. The center line, the axis about which the funnel is symmetrical, is not coincident with the center line of the speaker, but extends at an angle to it. This speaker is harder to produce. It has an appearance that implies lack of symmetry in its output and is generally considered to be less desirable than the others. Nonetheless, it does illustrate that the invention is not limited to the preferred embodiments shown in FIGS. 1 through 5.

I claim:

1. In a speaker of the kind in which a diaphragm is suspended at its margins from a frame and is caused to move in response forces applied to its mid region, the improvement which comprises:

a funnelling member in the form of a tapered tube having a larger opening at one of its ends than the smaller opening at the other;

said funnelling member having the margin of its larger opening in engagement with and fixed to said diaphragm such that it encompasses said mid region at which said forces are applied;

means in the form of said smaller opening for permitting flow of air into and out of the interior of said funnelling member as an incident to application of force to said diaphragm;

said funnelling member having generally elliptical cross-sectional shape in planes extending to it parallel to the plane of the margin of said larger opening; and said funnelling member having a length greater than the avereage diameter of said mid region encompassed by said larger end of the funnelling member such that it extends beyond the plane of said frame.

2. The invention defined in claim 1 in which said funnelling member is formed about an axis perpendicular to the plane of said frame and in which the length of the funnelling member exceeds the lesser width of said member at its greater opening and in which the area of the smaller opening is less than one-third of the area of said larger opening.

3. In a speaker of the kind in which a diaphragm is suspended at its margins from a frame and is caused to move in response to forces applied to its mid region, the improvement which comprises:

a funnelling member in the form of a tapered tube having a larger opening at one of its ends than the smaller opening at the other;

said funnelling member having the margin of its larger opening in engagement with and fixed to said diaphragm such that it encompasses said mid region at which said forces are applied;

means in the form of said smaller opening for permitting flow of air into and out of the interior of said funnelling member as an incident to application of force to said diaphragm;

said diaphragm being elliptical and conical;

said funnelling member being elliptical and conical and having its central line substantially coincident with that of said diaphragm; and said funnelling member becoming less elliptical and approaching circularity in the direction away from said diaphragm and having a taper such that the diameter of the smaller opening is no greater than half of the greatest width of the larger opening of said member.

4. The invention defined in claim 3 in which the ratio of the larger width to the smaller width of said funnelling member at the margin of the larger opening is between three and four to two; and in which the ratio of the height of the funnelling element to its largest width is between one and one and one-half to one.

5. In a speaker of the kind in which a diaphragm is suspended at its margins from a frame and is caused to move in response to forces applied to its mid region, the improvement which comprises:

a funnelling member in the form of a tapered tube having a larger opening at one of its ends than the smaller opening at the other;

said funnelling member having the margin of its larger opening in engagement with and fixed to said diaphragm such that it encompasses said mid region at which said forces are applied;

means in the form of said smaller opening for permitting flow of air into and out of the interior of said funnelling member as an incident to application of force to said diaphragm;

the area of said diaphragm encompassed by said funnelling member being less than its total area;

said funnelling member having a length greater than the average dimension across said larger end of the funnelling member.

6. The invention defined in claim 5 in which said funnelling member is formed around an axis perpendicular to the plane of said frame and in which the length of the funnelling member exceeds the width of said member at its greater opening and in which the area of the smaller opening is less than one-third of the area of said larger opening.

7. The invention defined in claim 6 in which the smaller opening at the end of said funnelling element has an average width that is between one-half and one-fourth of the funnel length.

8. The invention defined in claim 6 in which the area of the speaker diaphragm is approximately twice that of the area of the funnelling member at its larger end.

* * * * *